United States Patent [19]

Morgan

[11] Patent Number: 4,813,439

[45] Date of Patent: Mar. 21, 1989

[54] HAIR TREATMENT SOLUTION APPLICATOR

[76] Inventor: Susan Morgan, 97 4th Street, Garden City Park, N.Y. 11040

[21] Appl. No.: 60,101

[22] Filed: Jun. 9, 1987

[51] Int. Cl.[4] ..... A45D 24/22; A45D 24/26

[52] U.S. Cl. ..... 132/116; 132/112

[58] Field of Search ..... 132/112, 113, 114, 115, 132/116, 88, 7

[56] References Cited

U.S. PATENT DOCUMENTS

| | | | |
|---|---|---|---|
| 1,635,176 | 7/1927 | Dorment | 132/116 X |
| 2,618,275 | 11/1952 | Pearson | 132/112 |
| 2,956,570 | 10/1960 | Stanford | 132/116 |
| 4,592,376 | 6/1986 | Sigmund et al. | 132/112 |
| 4,605,026 | 8/1986 | Nolin | 132/112 |

FOREIGN PATENT DOCUMENTS

| | | | |
|---|---|---|---|
| 506374 | 10/1954 | Canada | 132/114 |
| 3244174 | 5/1984 | Fed. Rep. of Germany | 132/88.7 |
| 3520255 | 12/1985 | Fed. Rep. of Germany | 132/112 |
| 576786 | 5/1958 | Italy | 132/116 |

*Primary Examiner*—Steven A. Bratlie

*Attorney, Agent, or Firm*—Collard, Roe & Galgano

[57] ABSTRACT

There is provided a hair treatment solution applicator adapted to be attached to the mouth of a squeeze bottle containing the hair treatment solution by an attachment element having a dispensing valve therein. An applicator portion, in the form of a substantially flat or planar element lying in the plane of the squeeze bottle axis, is secured to the attachment element and is provided with a comb-like distributor element at its side remote from the attachment element. The planar applicator element is provided with a slot at the side which includes the distributor element which communicates with the dispensing valve. Substantially adjacent the comb-like distributor element, there is arranged an elongated spike-like, hair-sectioning pick extending perpendicular to the axis of the squeeze bottle in the plane defined by the applicator portion.

1 Claim, 1 Drawing Sheet

HAIR TREATMENT SOLUTION APPLICATOR

The present invention relates generally to a device for the application of a treatment solution such as a dye, a tint, a conditioner, a wave set solution and the like to the hair. More particularly, the present invention relates to a hand-held applicator which is especially adapted for the application of hair treatment solutions to the hair which is far more efficient and easier to operate than earlier such devices.

Many hair treatment solutions, particularly those utilized by professional hairdressers, require the treatment solution to be applied segmentally to the hair, lock by lock, until all of the hair strands have been treated. Such treatment solutions are generally contained in a plastic squeeze bottle having an applicator including dispensing means attached to the open mouth of the squeeze bottle. In the utilization of such an applicator, the hairdresser grasps the plastic squeeze bottle, squeezes the solution out and works the solution into the lock of hair being treated by means of the applicator essentially utilizing the bottle as a handle. The distribution element of the applicator can be in the form of a brush, a comb or a sponge material with dispensing means for transferring the hair treatment solution from the plastic squeeze bottle to the distribution element of the applicator which contacts the hair. A professional hairdresser, when utilizing such a hair treatment solution applicator with one hand, will simultaneously be utilizing the other hand to hold the hair already treated or that which is to be treated from getting in the way and interfering with the treatment of the lock of hair or strands of hair being worked on. Subsequent to the treatment of the lock of hair being worked on, the hairdresser must separate from the remaining hair to be treated the next lock of hair to be worked on and position the same so that the hair treatment solution can be applied thereto. In order to do this, it is necessary for the hairdresser to free a hand to be used for this separation, which is generally the hand which is holding the hair treatment solution bottle, since the other hand is holding the hair in place and preventing it from interfering with the work. With the now free hand, the hairdresser can separate the next lock of hair to be treated by utilizing a finger or a pick-like instrument, which is slipped beneath the lock of hair and separates or sections the same so that it can be positioned for treating purposes. This method, obviously, is very time-consuming and laborious for the hairdresser.

An attempt to ease this labor-intensive operation on the part of the hairdresser can be found in U.S. Pat. No. 4,605,026, granted Aug. 12, 1986, to Nolin, wherein the applicator attached to the dispensing opening or mouth of the hair treatment solution container or squeeze bottle is in the form of a comb having a frame member or spine from which extend the teeth of the comb and which is angularly attached to the open mouth of the container at a first end and which has extending from its second end a pick-like element for separating or sectioning the hair. The first end of the comb is attached to the open mouth of the container by means of a sealing cover element or cap. A duct is provided in the interior of the spine of the comb which communicates with the interior of the container via the open mouth thereof and which is provided with openings along the length of the spine of the comb for permitting the treatment solution to be released therethrough. The released treatment solution is then combed into the lock of hair which has been sectioned by the hairdresser. The disadvantages of this comb-like device relate to the angular disposition of the comb with respect to the treatment solution container, which acts as a handle therefor, and the rather small openings in the comb for release of the hair treatment solution The angular disposition, which preferably is indicated to be 45°, of the comb with respect to the hair treatment solution container, requires the hairdresser to maintain his or her arm in a raised position with the elbow positioned above the shoulder during application of the hair treatment solution. This is an awkward and very tiring position which the hairdresser must maintain throughout the application period. Also, the relatively small openings in the comb spine at the base of the comb teeth must occasionally be cleaned, since they are small and susceptible to clogging during use. It should also be noted with respect to the comb-like structure of U.S. Pat. No. 4,605,026 that the elongated teeth-like structure of the comb does not allow the application of hair treatment solution to the hair in proximity to the scalp of the person whose hair is being treated.

It is, therefore, the object of the present invention to provide an hair treatment solution applicator which s easier to utilize than such devices available heretofore as well as more efficient so that the treatment of the hair by a hairdresser is thereby facilitated and made more thorough.

The above object, as well as others which will hereinafter become apparent, is accomplished in accordance with the present invention by the provision of a hair treatment solution applicator adapted to be attached to the mouth of a squeeze bottle containing the hair treatment solution by an attachment element having a dispensing valve therein. An applicator portion, preferably in the form of a substantially flat or planar element lying in the plane of the squeeze bottle axis, is secured to the attachment element and is provided with a comb-like distributor element at its side remote from the attachment element. The planar applicator element is provided with a slot on the side which includes the distributor element. The slot extends through the planar applicator element and communicates with the dispensing valve. Substantially adjacent the comb-like distributor element, there is arranged an elongated spike-like, hair-sectioning pick extending perpendicular to the axis of the squeeze bottle and lying in the plane defined by the applicator portion.

Other objects and features of the present invention will become apparent from the following detailed description considered in connection with the accompanying drawing. It is to be understood, however, that the drawing is designed as an illustration only and not as a definition of the limits of the invention.

In the drawing, wherein similar reference characters denote similar elements throughout the several views.

Figure 1:
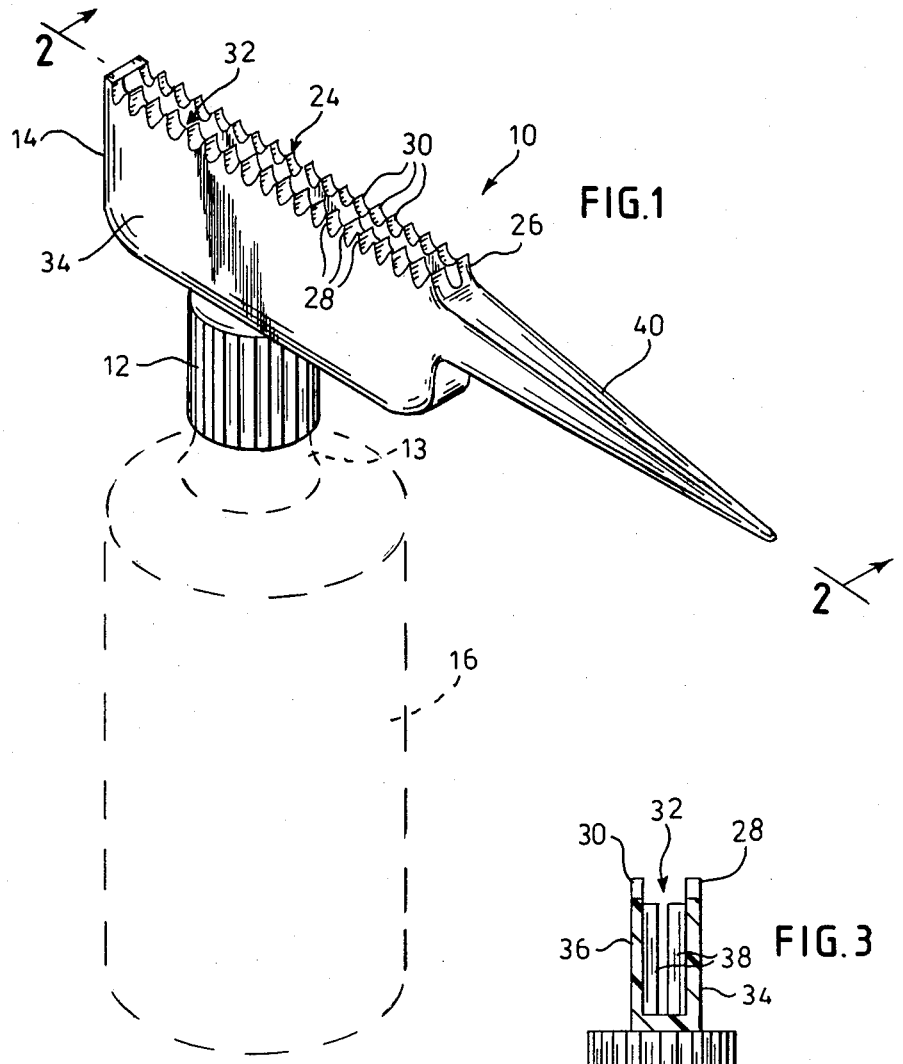
FIG. 1 is a perspective view of the hair treatment solution applicator according to the present invention.
Figure 3:
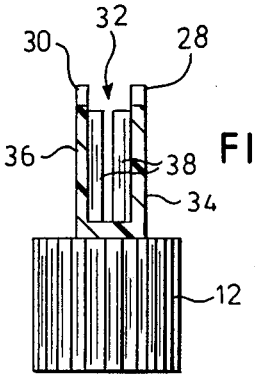
FIG. 3 is a partial cross-sectional view of the hair treatment solution applicator of FIG. 2 taken along the line 3—3 of FIG. 2.
Figure 2:
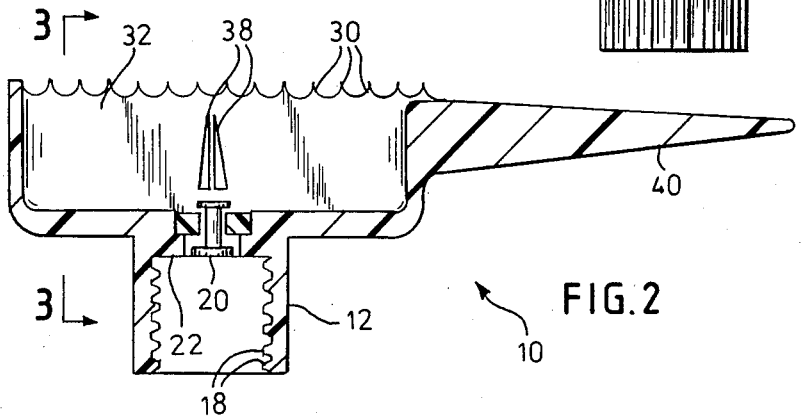
FIG. 2 is a cross-sectional view of the hair treatment solution applicator of FIG. 1 taken along the line 2—2 of FIG. 1.

Now turning to the drawing, there is shown in FIG. 1 a hair treatment solution applicator, generally designated 10, having an attachment element 12 and an applicator portion 14. Attachment element 12 is a cap or cover adapted to be attached to an elongated plastic squeeze bottle 16 (shown in phantom in FIG. 1) which contains the hair treatment solution to be applied. As clearly seen in FIG. 2, attachment element 12 may be in the form of a screw cap for bottle 16 having internal screw threads 18 for the attachment thereof to neck 13 of bottle 16. A dispensing valve, designated 20, is arranged in the top wall 22 of attachment element 12 and is adapted to dispense the hair treatment solution from bottle 16.

Applicator portion 14, which may be formed integrally with attachment element 12 or otherwise securely and rigidly attached thereto, is substantially planar in shape lying in a plane defined by the axis of bottle 16 and having at least one straight side, designated 24, perpendicular to the axis of bottle 16 remote from attachment element 12. A comb-like distributor element, designated 26, is provided at side 24 of applicator portion 14 and is formed of two parallel rows of shallow teeth 28 and 30 which run the longitudinal length of side 24 and are separated by slot 32. As clearly seen in FIG. 2, slot 32 extends through application portion 14 to define parallel walls 34 and 36 and communicates with dispensing valve 20. Walls 34 and 36 are maintained separated by spacer 38 centrally disposed between walls 34 and 36 within slot 32.

A spike-like hair sectioning pick, designated 40, extends from a side of applicator portion 14 adjacent side 24 in the plane defined by the applicator portion and perpendicular to the axis of bottle 16. Sectioning pick 40 is adapted to pick up, raise and/or separate a lock of hair from the scalp of the person receiving the hair treatment solution, which lock of hair is then treated, utilizing the teeth 28 and 30 of distributor element 24. Preferably, applicator 10 of the present invention is formed of molded plastic.

In utilizing hair treatment solution applicator 10 of the present invention, the hairdresser grasps squeeze bottle 16 in either hand and inverts the same so that hair treatment solution contained in bottle 16 can be squeezed through dispensing valve 20 and into slot 32 between walls 34 and 36. The hairdresser then passes the teeth of distributor element 26 through the lock of hair to be treated, thereby distributing the treating solution evenly throughout the lock of hair because of the combing action of parallel teeth 28 and 30. Next, the hairdresser inserts hair sectioning pick 40 into the hair for picking up, raising and/or separating the desired hair strands or lock next to be treated and, utilizing the pick, positions the lock of hair in order to treat the same. Teeth 28 and 30 are then passed through this next lock of hair to be treated while treatment solution is squeezed through valve 20 and distributed during the combing operation. Because of the shallowness of teeth 28 and 30, it is possible to apply the treatment solution in close proximity to the scalp of the person whose hair is being treated.

While only a single embodiment of the present invention has been shown and described, it will be obvious that many changes and modifications may be made thereunto without departing from the spirit and scope of the invention.

What is claimed is:

1. A hair treatment solution applicator formed of molded plastic, comprising:

a plastic squeeze bottle containing hair treatment solution, said squeeze bottle having a generally elongated axial length and an open mouth and being of a size suitable to be held in a user's hand;

a screw cap adapted for securement to the open mouth of the squeeze bottle and having a top wall covering the open mouth of the squeeze bottle;

a dispensing valve arranged in the top wall of said screw cap for dispensing the hair treatment solution from the bottle when the bottle is squeezed;

a substantially planar applicator portion consisting of two parallel spaced apart and laterally connected together walls defining a space therebetween attached to the top wall of said screw cap and having a spacer disposed between said parallel walls for maintaining their spaced-apart relationship , said applicator portion lying in a plane which includes the axis of said squeeze bottle and said spaced parallel walls each terminating in parallel straight edges remotely disposed from the connection to the top wall of said screw cap perpendicular to the axis of the bottle, said dispensing valve dispensing the hair treatment solution into the space between said parallel walls;

a comb-like distributor element consisting of two rows of parallel shallow teeth each arranged on one of the parallel straight edges of said spaced apart walls of said applicator portion and defining a rectangularly shaped trough therebetween, said trough being in fluid communication with the space defined between said parallel walls, each said row of shallow teeth consisting of a plurality of substantially triangularly shaped teeth serially connected at their base and having generally concavely shaped sides; and a spike-like hair sectioning pick extending from said applicator portion adjacent said comb-like distributor element perpendicular to the bottle axis and in the plane of said applicator portion.

* * * * *